US006055973A

United States Patent [19]

Gomez et al.

[11] Patent Number: 6,055,973

[45] Date of Patent: May 2, 2000

[54] BOW BODY CONSISTING OF TWO SEPARATE PARTS, AND BOW COMPRISING SAME

[75] Inventors: Augustin Gomez, Decines; Joël Gibon, Pavilly, both of France

[73] Assignee: Decathlon, Villeneuve d'Ascq, France

[21] Appl. No.: 09/125,645

[22] PCT Filed: Feb. 14, 1997

[86] PCT No.: PCT/FR97/00288

§ 371 Date: Aug. 20, 1998

§ 102(e) Date: Aug. 20, 1998

[87] PCT Pub. No.: WO97/31237

PCT Pub. Date: Aug. 28, 1997

[30] Foreign Application Priority Data

Feb. 23, 1996 [FR] France ..... 96 02577

[51] Int. Cl.[7] ..... F41B 5/00

[52] U.S. Cl. ..... 124/23.1; 124/88

[58] Field of Search ..... 124/23.1, 88

[56] References Cited

U.S. PATENT DOCUMENTS

| | | | |
|---|---|---|---|
| 3,176,674 | 4/1965 | Smith | 124/23.1 |
| 3,415,241 | 12/1968 | Bear | 124/88 X |
| 4,257,385 | 3/1981 | Stewart | 124/88 X |
| 4,693,230 | 9/1987 | Sugouchi | 124/88 |
| 4,966,124 | 10/1990 | Burling | 124/23.1 |
| 5,269,284 | 12/1993 | Pujos et al. | 124/88 |
| 5,469,834 | 11/1995 | Higgins et al. | 124/88 |

FOREIGN PATENT DOCUMENTS

| | | |
|---|---|---|
| 353174 | 1/1990 | European Pat. Off. . |
| 2356903 | 1/1978 | France . |
| 2573857 | 5/1986 | France . |
| 2580795 | 10/1986 | France . |

*Primary Examiner*—John A. Ricci
*Attorney, Agent, or Firm*—Wolf, Greenfield & Sacks, P.C.

[57] ABSTRACT

A bow comprises a body, two branches mounted on the body, and a string stretched between the two free ends of the branches. The body of the invention is made up of two distinct pieces that are fixed to each other, namely:

a) a front piece (2) whose end portions (2") are designed to receive the flexible branches; and b) a back piece (3) whose front face (3*a*) has the same profile as the back face (2*a*) of the front piece (2) so that it can be applied snugly against the back face (2*a*), and whose back face (3*b*) is locally shaped to form a grip (4). In addition, the side faces of the back piece (3) are in alignment with the side faces of the front piece (2), and the front piece (2) and the rear piece (3) are made of different materials and/or have different densities.

14 Claims, 2 Drawing Sheets

BOW BODY CONSISTING OF TWO SEPARATE PARTS, AND BOW COMPRISING SAME

FIELD OF THE INVENTION

The present invention relates to the domain of leisure bows, in particular for target archery. It relates more particularly to a body for a bow.

BACKGROUND OF THE INVENTION

Leisure bows of the type made up of two flexible branches equipped with a central grip are generally used for beginners. However, it is now conventional for a leisure bow to be made up of a rigid body receiving two flexible branches between the ends of which the bow string is stretched. Such a one-piece body is made of glued laminated wood, or by casting, e.g. using a magnesium alloy, or else by machining, e.g. using aluminum.

The body has a particular configuration since its top has a narrow zone constituting the window of the bow, in which the arrow-support and sight-support accessories are fixed, and, under the window, it has a shaped grip against which the palm of the hand is applied while the bow is being used. The grip may optionally be covered with an overgrip, e.g. with it being possible for the overgrip to swivel resiliently about an axis, as described in Document FR A 2 580 795.

A bow is an assembly of a body, of two branches, of a string and of accessories that are fixed to the body: arrow supports, sight supports, stabilizers, and optionally power-adjustment means.

SUMMARY OF THE INVENTION

An object that the Applicants have set out to achieve is to propose an even wider selection of options making up any given bow.

This object is achieved by the body of the invention which is designed to equip a bow that also comprises two branches mounted on said body, and a string stretched between the two free ends of said branches.

In a manner characteristic of the invention, the body is made up of two distinct pieces that are fixed to each other, namely:

a) a front piece whose end portions are designed to receive the flexible branches; and b) a back piece whose front face has the same profile as the back face of the front piece so that it can be applied snugly against said back face, and whose back face is locally shaped to form a grip;

in addition, the side faces of the back piece are in alignment with the side faces of the front piece.

It can be understood that the front and back pieces may be of different colors, shapes, or styles, provided that the above-defined structural characteristics are satisfied. Thus, the invention makes it possible to obtain a very wide variety of combinations of front and back pieces to make up any given bow body.

In addition to the mere appearance, relating to varying colors and shapes, the invention advantageously makes it possible to modify the behavior of the bow. For this purpose, the pieces making up the body are made of different materials and/or have different densities.

This is totally impossible to achieve with one-piece bodies.

Preferably, the front piece of the body of the invention is made of glued laminated wood, and the back piece is made of a plastics material or of a metal material.

In a conventional bow, the body is made of glued laminated wood, of a molded plastics material, or of a cast or machined metal material. The behavior of the bow, its performance, and the sensations that it procures for the archer are, in particular, functions of the make-up of the body.

By means of the invention, it is thus possible to obtain behavior, performance, and sensations that have previously been impossible to achieve, by combining two different materials, or two different densities of the same material.

Furthermore, vibration in a bow is a known problem. Document FR A 2 356 903, describes an attempt to solve that problem by separating the grip from the body, and by mounting said grip on said body by resilient means. According to that Patentee, since the grip is separated from the body, it should be capable of vibrating independently of the body and of the branches of the bow.

To the best of the Applicants' knowledge, the bow described in that prior document has never been put to practical use.

Another object of the invention is to provide a bow body that mitigates the above-mentioned drawback of vibration which, according to the Applicants, is generated mainly by the branches of the bow after the arrow has been loosed.

This object is achieved by means of the body of the invention which includes a damping insert disposed between the back face of the front piece and the front face of the back piece, prior to the two pieces being assembled together.

It is the front piece that is the seat of the vibration caused by the branches. The damping insert acts as a kind of insulator to insulate the back piece from the front piece so that the vibration of the front piece is not transmitted to the back piece and therefore to the grip or is transmitted thereto a lesser extent.

The two pieces making up the body may be fixed together either permanently, e.g. by means of self-tapping screws, or else in removable manner, by conventional fixing means.

In addition, advantageously, the shooting accessories such as arrow supports and sight supports are mounted on the back piece only. In which case, manufacture of the front piece is simplified.

Advantageously, the bow body of the invention is further provided with two branch supports, each support being fixed to a respective end of the front piece, on the front face thereof.

The invention also provides a bow comprising two branches mounted on the above-defined body made up of two distinct pieces, and a string stretched between the two free ends of said branches.

BRIEF DESCRIPTION OF THE DRAWINGS

The present invention will be better understood on reading the following description of a preferred embodiment of a bow body made up of two distinct pieces, with reference to the accompanying drawing, in which.

DETAILED DESCRIPTION

Figures 1, 2, 3:
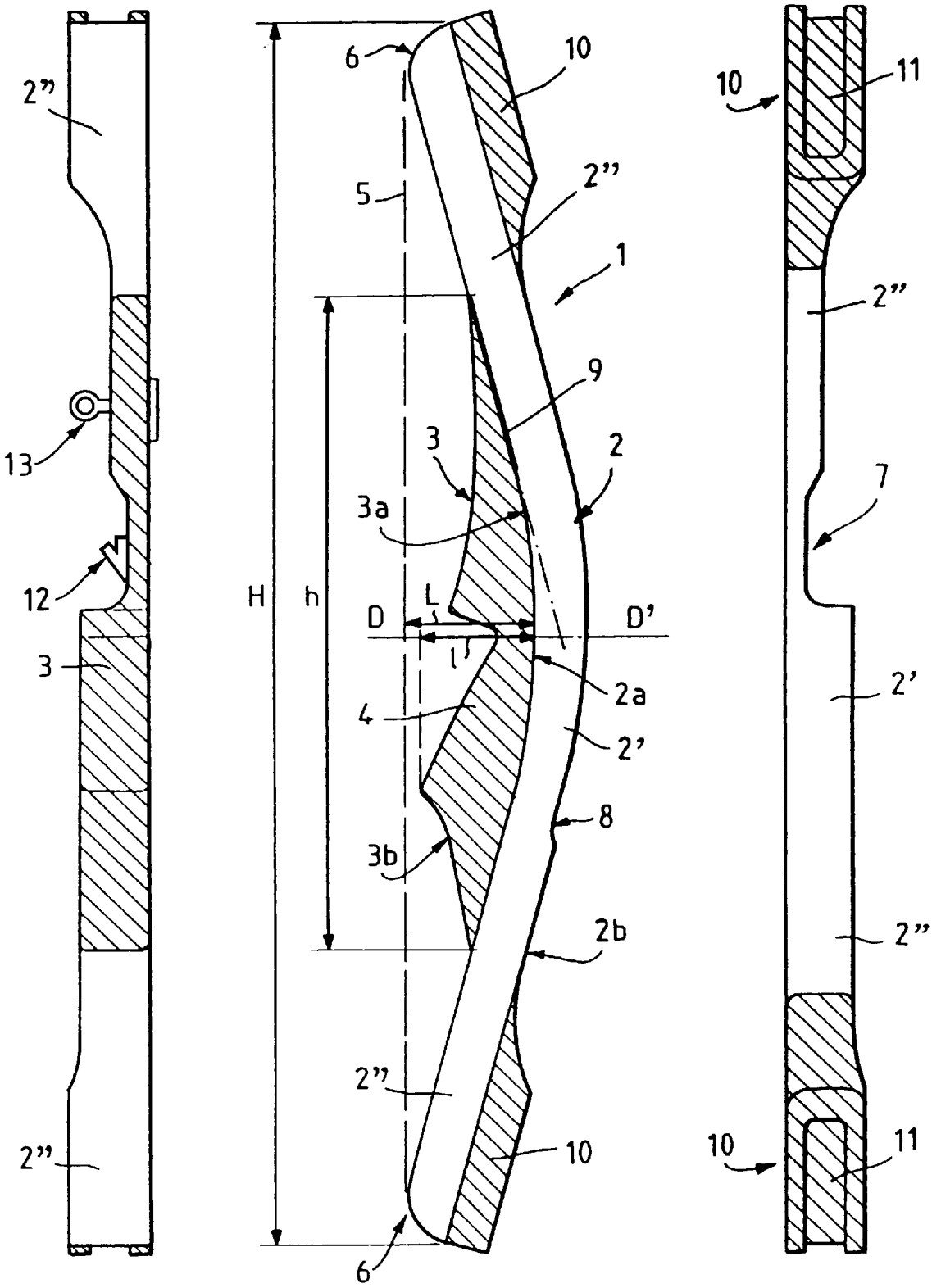
FIG. 1 is a diagrammatic side view of the body.
FIG. 2 is a diagrammatic front view of the body.
FIG. 3 is a diagrammatic back view of the body.
Figure 4:
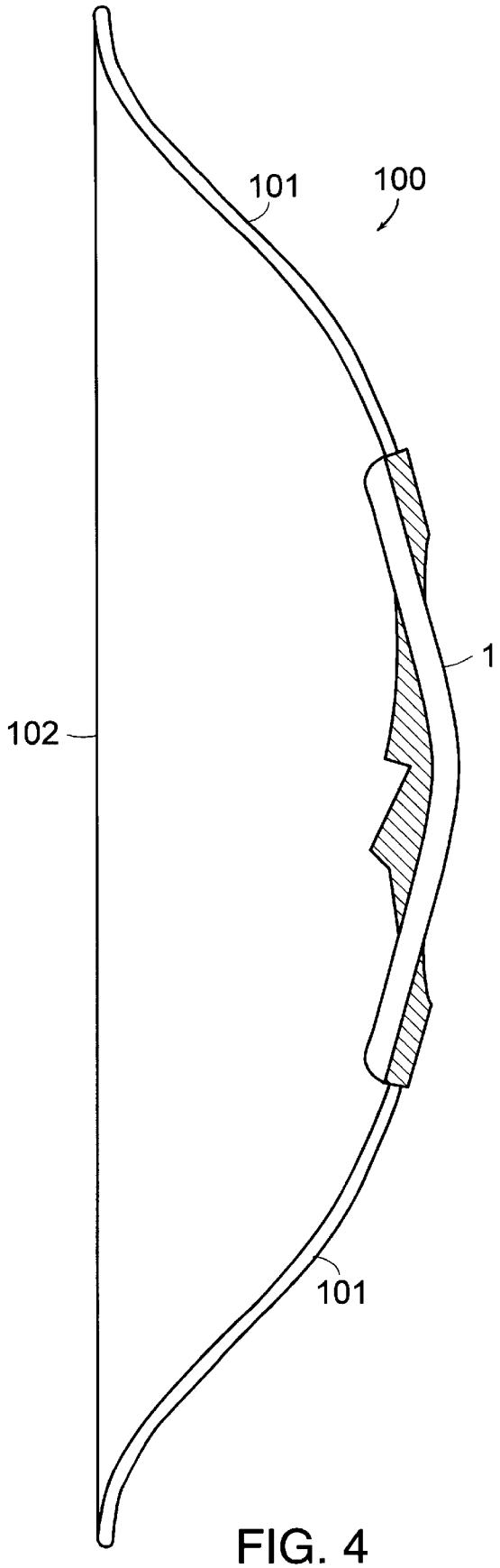
FIG. 4 is a diagrammatic side view of the body of this invention mounted on a conventional bow.

A leisure bow is 100 made up of a central element, (also generally referred to as the "body" of the bow) fixed to two flexible branches 101 between the ends of which the string 102 of the bow is stretched. In the vicinity of its middle zone, the body is shaped to form a grip against which the archer applies a hand on bending the bow and on shooting the arrow.

The flexible branches are deformed on stringing the bow. For example, they be made of a composite material formed of hard wood and of glass fibers having a high modulus of elasticity, or else of glass fibers and laminated graphite.

The body imparts rigidity and balance to the bow, and, more generally, makes the bow comfortable for the archer. Such a body is a one-piece element which may be made of glued laminated wood, or of a molded or machined plastics or metal material, e.g. a magnesium alloy or aluminum.

The body 1 of the present invention differs from currently-known prior art bodies in that it is made up of two distinct pieces 2, 3 which are fixed together, namely a front piece and a back piece. The front piece 2 has a back face 2*a* which, in the example shown, is curved into a circular arc in its central portion 2', and is plane in its end portions 2". The back piece 3 has a front face 3*a* that has the same profile as the back face 2*a* of the front piece 2 so as to be applied snugly against said face 2*a* on assembly, and has a back face 3*b* which is recessed to form a shaped grip 4.

The terms "front" and "back" are used to describe the bow as held facing the target. The back piece 3 and its front face are thus closer to the archer, whereas the front piece 2 and its back face are closer to the target.

As shown clearly in FIG. 1, the central portion 2' of the back face 2*a* of the front piece 2 is curved into a circular arc centered on the axis DD' of the body 1. Beyond this curvature, the back face 2*a* is plane in the end portions 2" of the front piece 2.

The back piece 3 has a front face 3*a* which has exactly the same profile as the back face 2*a* of the front piece 2, so that the back piece 3 can be applied snugly against the front piece 2 and fixed thereto by any fixing means. In the example shown, the back piece has a height h that is significantly less than the height H of the front piece, and a depth 1, as measured at the same level as the axis DD', that is substantially equal to or less than the distance L between the back face 2*a* of the front piece and the plane 5 containing the rearmost edges of the front piece 2. Thus, the body 1 lies within a rectangular block type volume which is defined by the front piece 2, thereby in particular facilitating stowage of the body.

The front piece 2 and the back piece 3 have exactly the same widthwise configuration, as shown in FIGS. 2 and 3, the back piece 3 being exactly in alignment with the front piece 2.

Above the axis DD', the front piece 2 and the back piece 3 are recessed widthwise to form the window 7. Preferably, the shooting accessories such as the arrow support 12 and the sight 13 support are fixed to the side of the back piece 3 in the window 7.

The grip 4 is formed by recessing the back piece 3 substantially starting from the axis DD' and going downwards therefrom. Optionally, at the grip 4, the front piece 2 may be made slightly narrower so as to enable the bow to be grasped better by the archer when said archer takes hold of the body 1 at the grip 4.

In a preferred embodiment, the front piece 2 is made of glued laminated wood whereas the back piece 3 is made of a plastics material or of a metal material that may be cast or machined. Thus, by subdividing the body 1 into two distinct pieces 2, 3, it is possible to create bodies of different appearance, by means of different combinations of front and back pieces 2 and 3. In particular, a given front piece 2 can be combined with a back piece 3 chosen from a range of different colors, shapes, and styles. More importantly, such subdivision makes it possible to combine different materials for the front piece 2 and for the back piece 3, thereby making it possible to combine the specific performance and behavior of each of the materials. It is known that the weight of a bow is an important parameter for the comfort of the archer, for the balance of the bow, and also for natural damping of vibration. By means of the invention, it is possible to vary the weight by choosing, for example, a back piece (3) from various possible weights, depending on the build and the skill of the archer.

Another advantage of subdividing the body 1 into two distinct pieces lies in the fact that it is possible to interpose a damping insert 9 which fits snugly between the back face 2*a* of the front piece 2 and the front face 3*a* of the back piece 3. The purpose of the damping insert is to damp any vibration caused by the branches on loosing the arrow. For example, the damping insert 9 may be made of a material having a certain amount of resilience, of the rubber type. By means of this insert 9, the vibration does not reach the back piece 3 and therefore the grip 4 or reaches them in attenuated manner only, thereby improving the comfort of the archer.

In the example shown, the flexible branches 101 are mounted at the ends 2" of the front piece 2 by means of branch supports 10 which are fixed to the front face 2*b* of the front piece 2.

Each branch support 10 is provided with an internal recess into which the end of a flexible branch can be inserted by sliding in interfitting manner. A window 11 provided at the top of the branch support 10 gives access to the fixing means for fixing the corresponding flexible branch to the front piece 2. The fixing means, which may, for example, be a hinged catch mounted on the high portion of a screw, does not extend beyond the sides of the body of the bow.

In addition, the presence of the two branch supports 10 makes it possible to give the body 1 a matching appearance, by an appropriate choice of colors and shapes, in combination with those of the front and back pieces 2 and 3. In the example shown, the branch supports 10 are the same color as the back body 3, and optionally made of the same material.

The present invention is not limited to the preferred embodiment described above by way of non-exhaustive example. In particular, the shapes, the dimensions, and the materials of the front and back pieces may be determined as a function of the desired type of use, of the performance to be achieved, and of the desired appearance. In particular, although a curved shape is preferred for the front piece, to give the flexible branches the desired inclination, it is not essential.

It should also be noted that the invention considerably modifies the way the body of the bow is manufactured, because it is possible to make a glued laminated wood front piece 2 that is much simpler to manufacture since it does not include the complicated shapes of the grip, and because molding or machining the back piece 3 requires molds that are smaller and therefore less costly. Finally, it is possible to consider that the front piece 2 is a kind of standard part, whereas the back piece 3 and optionally the branch supports 10 are additional parts, thereby making it possible to offer a full range of colors and of shapes, which range can be modified over time.

What is claimed is:

1. A body for a bow that comprises two branches mounted on said body, and a string stretched between two free ends of said branches, said body comprising:

a front piece having end portions designed to receive the branches and a back face; and a back piece affixed to said front piece and having a back face and a front face having a same profile as the back face of the front piece, said front face of said back piece being applied snugly against said back face of said front piece, said back face of said back piece being locally shaped to form a grip, side faces of the back piece being in alignment with side faces of the front piece.

2. The body according to claim 1, wherein the front piece and the rear piece are made of different materials.

3. The body according to claim 2, wherein the front piece is made of glued laminated wood, and the back piece is made of a plastic material.

4. The body according to claim 2, wherein the front piece is made of glued, laminated wood, and the back piece is made of metal.

5. The body according to claim 1, wherein the back face of the front piece is curved into a circular arc in a central portion and is plane in end portions.

6. The body according to claim 1, further comprising a damping insert disposed between the back face of the front piece and the front face of the back piece.

7. The body according to claim 1, wherein shooting accessories are mounted on one side of the back piece.

8. The body according to claim 7 wherein said shooting accessories comprise an arrow support.

9. The body according to claim 7 wherein said shooting accessories comprise a sight support.

10. The body according to claim 1, further comprising two branch supports, each support being fixed to a respective end of a front piece, on the front face thereof.

11. A bow comprising a body according to claim 1, two branches mounted on said body, and a string stretched between two free ends of said branches.

12. The body according to claim 1 wherein the front piece and the rear piece are made of materials having different densities.

13. The body according to claim 12, wherein the front piece is made of glued laminated wood, and the back piece is made of metal.

14. The body according to claim 12, wherein the front piece is made of glued laminated wood, and the back piece is made of a plastic material.

* * * * *